US006050877A

United States Patent [19]

Shibata et al.

[11] Patent Number: 6,050,877

[45] Date of Patent: Apr. 18, 2000

[54] APPARATUS AND METHOD FOR GRINDING EYEGLASS LENSES

[75] Inventors: Ryoji Shibata; Hirokatsu Obayashi, both of Aichi, Japan

[73] Assignee: Nidek Co., Ltd., Aichi, Japan

[21] Appl. No.: 08/961,952

[22] Filed: Oct. 31, 1997

[30] Foreign Application Priority Data

Oct. 31, 1996 [JP] Japan ..... 8-307183

[51] Int. Cl.[7] ..... B24B 9/14

[52] U.S. Cl. ..... 451/5; 451/43; 451/256

[58] Field of Search ..... 451/5, 43, 42, 451/255, 256

[56] References Cited

U.S. PATENT DOCUMENTS

| | | | |
|---|---|---|---|
| 4,912,880 | 4/1990 | Haddock et al. | 451/43 |
| 4,945,684 | 8/1990 | Wada et al. | 451/43 |
| 5,074,079 | 12/1991 | Park | 451/43 |
| 5,138,770 | 8/1992 | Matsuyama . | |
| 5,333,412 | 8/1994 | Matsuyama . | |
| 5,347,762 | 9/1994 | Shibata et al. . | |

FOREIGN PATENT DOCUMENTS

| | | |
|---|---|---|
| 0444902 | 9/1991 | European Pat. Off. . |
| 0802020 | 10/1997 | European Pat. Off. . |
| 5277920 | 10/1993 | Japan . |
| 2092489 | 8/1982 | United Kingdom . |

*Primary Examiner*—Robert A. Rose
*Attorney, Agent, or Firm*—Sughrue, Mion, Zinn, Macpeak & Seas, PLLC

[57] ABSTRACT

An eyeglass lens grinding machine for grinding the periphery of a lens to fit into an eyeglass frame includes a lens rotating section which holds and rotates the lens to be processed, a configuration data inputting section for entering the configuration data on the eyeglass frame or a template therefor, a layout data inputting section for entering data to be used in providing a layout of the lens corresponding to the eyeglass frame, a processing data calculating section for calculating processing data on the basis of the data entered by the configuration data inputting section and the layout data inputting section, a rotational speed varying section which, in at least a portion of the grinding process controls variably the rotational speed of the lens rotating section in accordance with the amount of processing as relative to the angle of rotation, and a control section for controlling to grind the lens on the basis of the processing data obtained by the processing data calculating section. The eyeglass lens grinding machine can shorten the time for processing lenses sufficiently to increase the processing efficiency while ensuring highly precise processing.

25 Claims, 11 Drawing Sheets

APPARATUS AND METHOD FOR GRINDING EYEGLASS LENSES

BACKGROUND OF THE INVENTION

The present invention relates to an apparatus and a method for grinding the periphery of an eyeglass lens to fit into an eyeglass frame.

An eyeglass lens grinding machine is known and this machine grinds a lens on the basis of the frame configuration data obtained by tracing (profiling) an eyeglass frame with a tracer. The machine has lens grinding abrasive wheels which are driven to rotate at high speed and a carriage which clamps the lens between rotating shafts and holds it rotatably. With the lens being revolved, the carriage is rotationally moved on the basis of the frame configuration data such that the distance between the axis of the lens rotating shaft and that of the abrasive wheel rotating shaft is adjusted to permit the grinding of the edge of the lens as it is brought in contact with the abrasive wheel. During the grinding operation, the carriage is rotationally moved such that the grinding pressure on the abrasive wheel is maintained constant by a spring force or the like so that no load exceeding a specified value will be exerted on the lens; hence, the lens makes a plurality of revolutions until it acquires a profile (configuration) that fits the eyeglass frame.

The conventional eyeglass lens grinding machine is designed such that the rotational speed of the lens is independent of the profile (configuration) of the lens being processed and it is held at a generally constant value. This means that in a portion of the lens to be processed to have a large size or diameter, the intended processing ends with a few number of revolutions but even after the processing of that portion has ended, the lens continues to revolve at the same speed, which eventually causes a waste of time before the processing of the whole lens is complete.

Another problem with the approach of rotating the lens at constant speed is that the point of contact between the lens and the abrasive wheel moves at different speeds depending on the shape (configuration) of the lens to be processed. Take, for example, a lens of the geometry shown in FIG. 13; areas of the lens around point A where it contacts the abrasive wheel will move very fast compared with areas around point B. This is a potential cause of introducing an error in the size or diameter of the processed lens and the error is prone to be conspicuous in a lens such as a plus lens which has its edge thickness increased toward the center.

SUMMARY OF THE INVENTION

The present invention has been accomplished under these circumstances and has as an object providing an eyeglass lens grinding machine which shortens the time for processing lenses sufficiently to improve the processing efficiency and which yet is capable of performing the desired processing with high precision.

Another object of the invention is to provide a method capable of such satisfactory grinding operations.

The stated objects of the invention can be attained by the following.

(1) An eyeglass lens grinding machine for grinding the periphery of a lens to fit into an eyeglass frame, which comprises lens rotating means for holding and rotating the lens to be processed, configuration data inputting means for entering configuration data on said eyeglass frame or a template therefor, layout data inputting means for entering data to be used in providing a layout of the lens corresponding to the eyeglass frame, processing data calculating means for calculating processing data on the basis of the data entered by said configuration data inputting means and said layout data inputting means, rotational speed varying means, provided for at least partial processing of the lens, for varying the rotational speed of said lens rotating means in accordance with the amount of processing relative to an angle of lens rotation, and control means for controlling to process the lens on the basis of the processing data obtained by said processing data calculating means.

(2) The eyeglass lens grinding machine of (1), which further comprises detection means for detecting a processed portion of the lens during the processing, and wherein said rotational speed varying means varies the rotational speed of said lens rotating means faster for the processed portion of the lens than for the yet to be processed portion on the basis of the result of detection by said detection means.

(3) The eyeglass lens grinding machine of (1), which further comprises speed calculating means for calculating a speed, at which a point of contact between an intended lens profile and an abrasive wheel moves during processing, on the basis of the processing data obtained by the processing data calculating means, and wherein said rotational speed varying means varies the rotational speed of said lens rotating means in accordance with the speed of movement obtained by said speed calculating means.

(4) The eyeglass lens grinding machine of (3), wherein the rotational speed varying means varies the rotational speed of said lens rotating means during specular processing or tapered edge processing.

(5) An eyeglass lens grinding machine for grinding the periphery of a lens to fit-into an eyeglass frame, which comprises lens rotating means for holding and rotating the lens to be processed, configuration data inputting means for entering configuration data on said eyeglass frame or a template therefor, layout inputting means for entering data to be used in providing a layout of the lens corresponding to said eyeglass frame, edge thickness detection means for detecting edge thickness of the lens on the basis of the data entered by said configuration data inputting means and said layout data inputting means, processing data calculating means for calculating processing data on the basis of the data entered by said edge thickness detection means, said configuration data inputting means and said layout data inputting means, rotational speed varying means, provided for at least partial processing of the lens, for varying the rotational speed of said lens rotating means in accordance with the amount of processing relative to an angle of lens rotation, and control means for controlling to process the lens on the basis of the processing data obtained by said processing data calculating means.

(6) The eyeglass lens grinding machine of (5), which further comprises detection means for detecting a processed portion of the lens during processing, and wherein said rotational speed varying means varies the rotational speed of said lens rotating means faster for the processed portion of the lens than for the yet to be processed portion, on the basis of the result of detection by said detection means.

(7) The eyeglass lens grinding machine of (5), which further comprises speed calculating means for calculating a speed, at which a point of contact between an intended lens profile and an abrasive wheel moves during processing, on the basis of the processing data obtained by said processing data calculating means, and wherein said rotational speed varying means varies the rotational speed of said lens rotating means in accordance with the speed of movement obtained by said speed calculating means.

(8) The eyeglass lens grinding machine of (7), wherein said rotational speed varying means varies the rotational speed of said lens rotating means so that the point of contact between the rotational abrasive wheel and the lens moves at a generally constant speed.

(9) The eyeglass lens grinding machine of (8), wherein said rotational speed varying means varies the rotational speed of said lens rotating means during specular processing or tapered edge processing so that the point of contact between the rotational abrasive wheel and the lens moves at the generally constant speed.

(10) The eyeglass lens grinding machine of (5), wherein said rotational speed varying means varies the rotational speed of the lens rotating means on the basis of the edge thickness information-obtained by said edge thickness detection means.

(11) A method for grinding the periphery of an eyeglass lens to fit into an eyeglass frame, which comprises steps of providing configuration data on said eyeglass frame or a template therefor, providing data to be used in providing a layout of the lens corresponding to said eyeglass frame, calculating processing data on the basis of both said configuration data and said layout data, holding the lens and rotating it by lens rotating means, and grinding the lens, with the rotational speed of said lens rotating means being variably controlled, for at least partial processing, in accordance with the amount of processing relative to an angle of lens rotation.

(12) A method for grinding the periphery of an eyeglass lens to fit into an eyeglass frame, which comprises steps of providing configuration data on said eyeglass fame or a template therefor, providing data to be used in providing a layout of the lens corresponding to said eyeglass frame, detecting the edge thickness of the lens on the basis of said configuration data and said layout data, calculating processing data on the basis of said edge thickness data, said configuration data and said layout data, holding the lens and rotating it by lens rotating means, and grinding the lens, with the rotational speed of said lens rotating means being variably controlled, for-at least partial processing, in accordance with the amount of processing relative to an angle of lens rotation.

DETAILED DESCRIPTION OF THE PREFERRED EMBODIMENT

An embodiment of the invention will now be described in detail with reference to the accompanying drawings.

General Layout of the Machine

Figure 1:
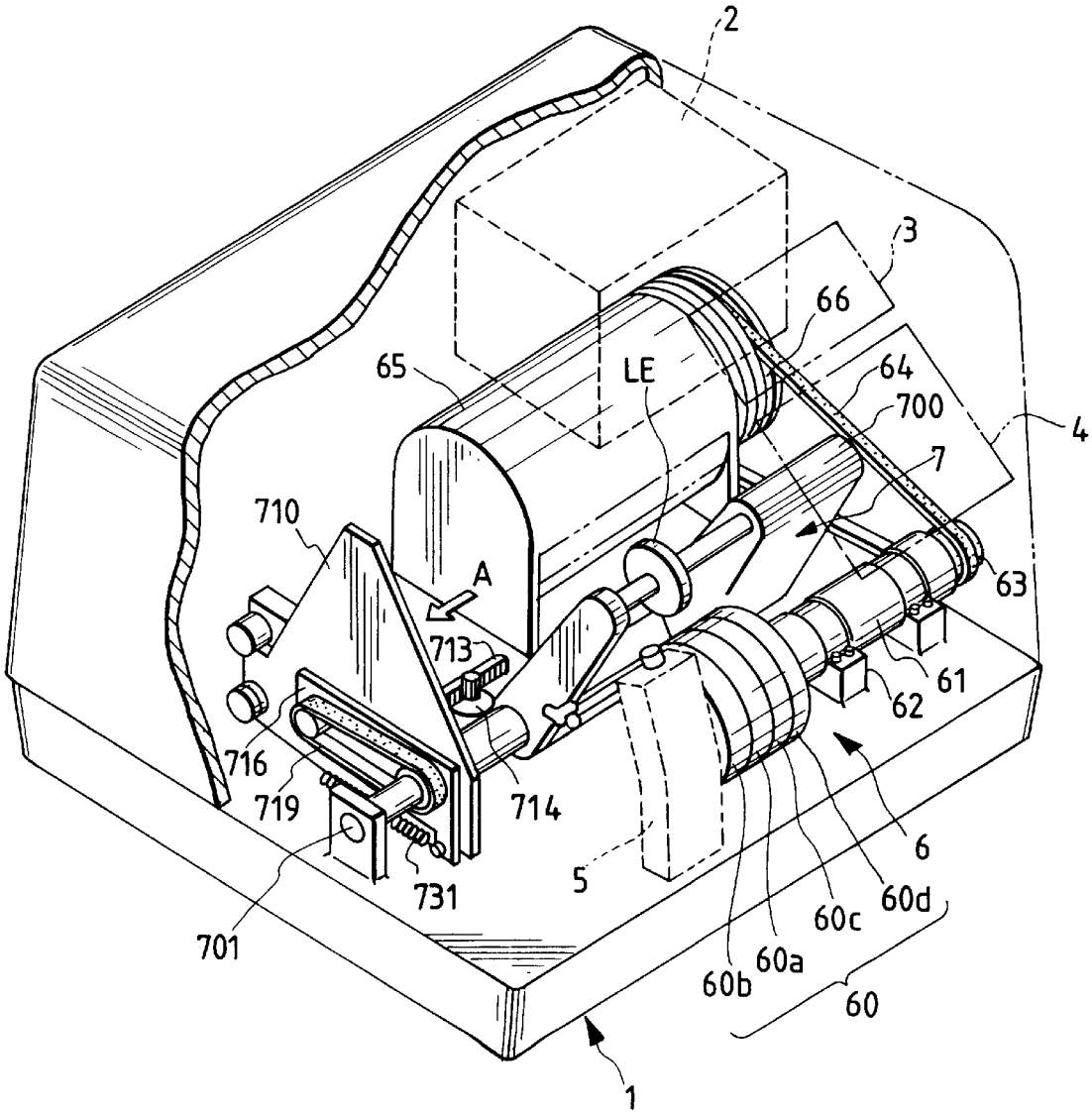
FIG. 1 is a perspective view showing the general layout of the eyeglass lens grinding machine of the invention.

FIG. 1 is a perspective view showing the general layout of the eyeglass lens grinding machine of the invention. The reference numeral 1 designates a machine base, on which the components of the machine are arranged. The numeral 2 designates an eyeglass frame and template configuration measuring device, which is incorporated in the upper section of the grinding machine to obtain three-dimensional configuration data on the geometries of the eyeglass frame and the template. Arranged in front of the measuring device 2 are a display section 3 which displays the results of measurements, arithmetic operations, etc. in the form of either characters or graphics, and an input section 4 for entering data or feeding commands to the machine. Provided in the front section of the machine is a lens configuration measuring device 5 for measuring the imaginary edge thickness, etc. of an unprocessed lens.

The reference numeral 6 designates a lens grinding section, where an abrasive wheel group 60 made up of a rough abrasive wheel 60*a* for use on glass lenses, a rough abrasive wheel 60*b* for use on plastic lenses, a finishing abrasive wheel 60*c* for tapered edge (bevel) and plane processing operations and a specular processing (polishing) abrasive wheel 60*d* is mounted on an abrasive wheel rotating shaft 61, which is attached to the machine base 1 by means of fixing bands 62. A pulley 63 is attached to an end of the abrasive wheel rotating shaft 61. The pulley 63 is linked to a pulley 66 via a belt 64, with the pulley 66 being attached to the rotational shaft of an AC motor 65. Accordingly, the rotation of the motor 65 causes the abrasive wheel group 60 to rotate. Shown by 7 is a carriage section and 700 is a carriage.

Layout of the Major Components (A) Carriage Section

Figure 2:
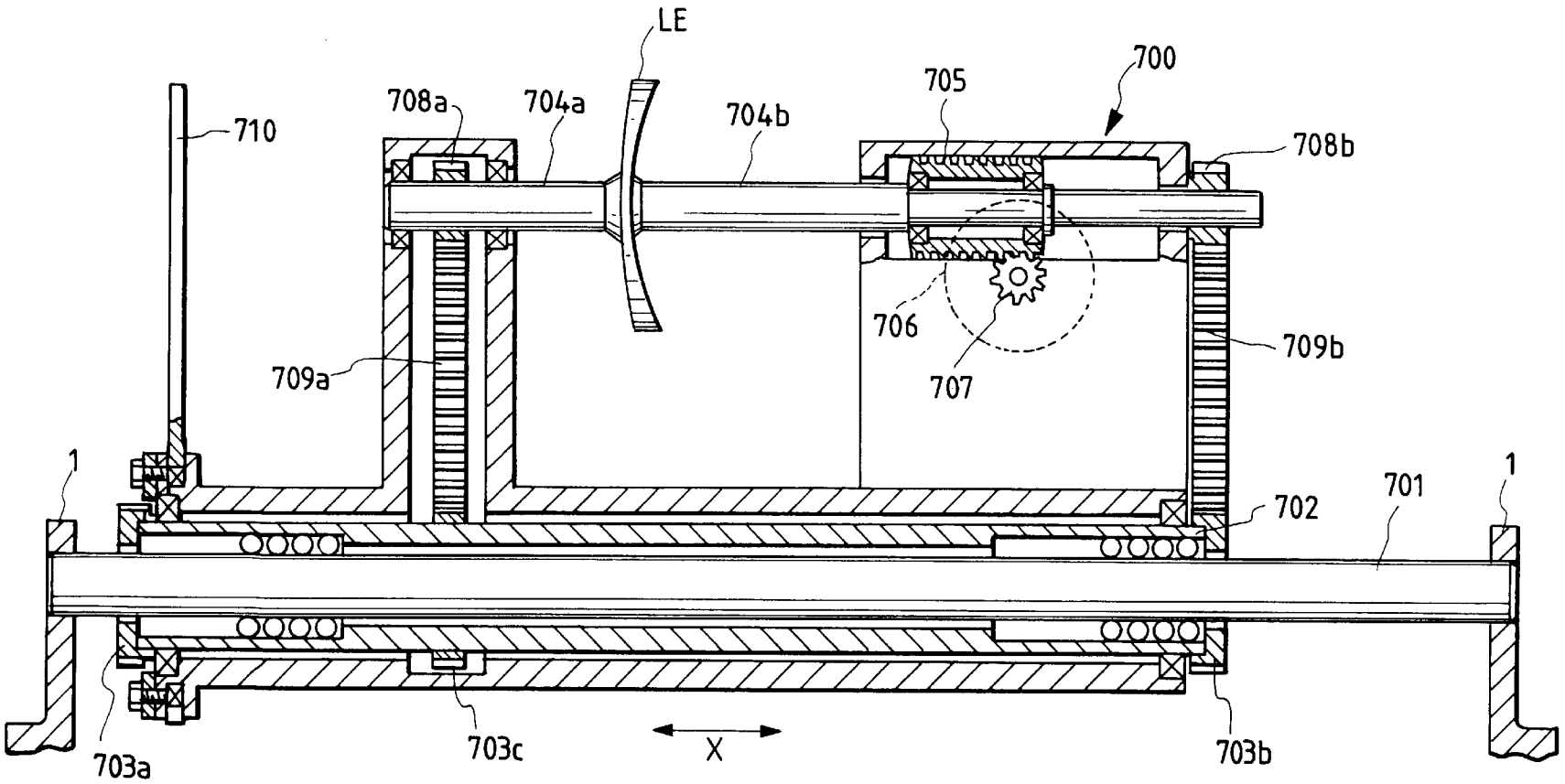
FIG. 2 is a cross-sectional view of the carriage in the grinding machine.
Figure 3:
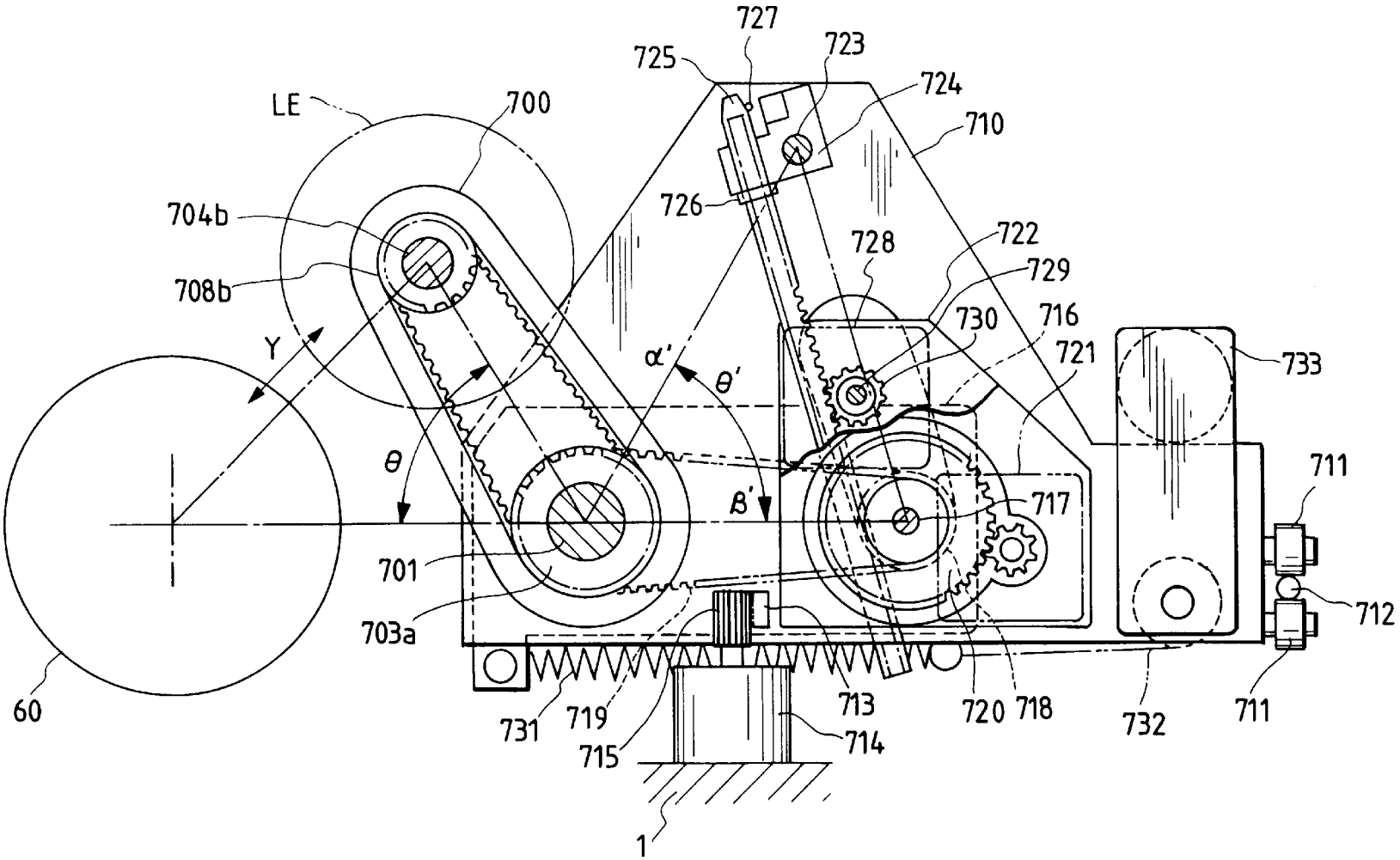
FIG. 3 is a diagram showing a drive mechanism for the carriage, as viewed in the direction of arrow A in FIG. 1.

The construction of the carriage section will now be described with reference to FIGS. 1 to 3. FIG. 2 is a cross-sectional view of the carriage, and FIG. 3 is a diagram showing a drive mechanism for the carriage, as viewed in the direction of arrow A in FIG. 1. The carriage 700 is so adapted that it not only chucks the workpiece lens (lens to be processed) LE for rotation but also adjusts the distance of the lens LE with respect to the abrasive wheel rotating shaft 61 and its position in the direction of lens rotating shafts 704*a*, 704*b*. In the following description, the axis extending in the direction for adjustment of the distance between the abrasive wheel rotating shaft 61 and each of the lens rotating shafts 704*a*, 704*b* will be referred to as the Y-axis and the axis along which the lens is moved parallel to the abrasive wheel rotating shaft 61 is called the X-axis.

a: Lens Chucking Mechanism

A shaft 701 is secured on the base 1 and a carriage shaft 702 is rotatably and slidably supported on the shaft 701; the carriage 700 is pivotally supported on the carriage shaft 702. Lens rotating shafts 704*a* and 704*b* are coaxially and rotatably supported on the carriage 700, extending parallel to the shaft 701 and with the distance therefrom being unchanged. The lens rotating shaft 704*b* is rotatably supported in a rack 705, which is movable in the axial direction by means of a pinion 707 fixed on the rotational shaft of a motor 706; as a result, the lens rotating shaft 704*b* is moved axially such that it is opened or closed with respect to the other lens rotating shaft 704*a*, thereby holding the lens LE in position.

b: Lens Rotating Mechanism

A drive plate 716 is securely fixed at the left end of the carriage 700 and a rotational shaft 717 is rotatably provided on the drive plate 716, extending parallel to the shaft 701. A gear 720 is provided at the right end of the rotational shaft 717 to mesh with a gear attached on a pulse motor 721, which is secured on a block 722 which is rotatably attached to the drive plate 716 in such a way that it is coaxial with the rotational shaft 717. When the pulse motor 721 rotates, a pulley 718 attached at the left end of the rotational shaft 717 rotates and the resulting rotation is transmitted to the shaft 702 via a timing belt 719 and a pulley 703*a*. The rotation of the shaft 702 in turn is transmitted to the lens chucking shafts 704*a* and 704*b* by means of pulleys 703*c* and 703*b* securely fixed on the shaft 702, pulleys 708*a* and 708*b* attached to the lens rotating shafts 704*a* and 704*b*, respectively, and timing belts 709*a* and 709*b* which connect the respective pulleys. Therefore, the rotation of the pulse motor 721 causes the lens chucking shafts 704*a* and 704*b* to rotate in synchronism.

c: Mechanism for Movement in the Direction of X-axis

An intermediate plate 710 is rotatably secured at the left end of the carriage 700. The intermediate plate 710 has a rack 713 which meshes with a pinion 715 attached to the rotational shaft of a carriage moving motor 714 secured to the base 1, extending parallel to the shaft 701. Two cam followers 711 are provided on the side of the intermediate plate 710 which is away from the operator such that they clamp a guide shaft 712 secured on the base 1, extending parallel to the shaft 701. With this arrangement, the motor 714 is capable of moving the carriage 700 in the axial direction of the shaft 701 (in the direction of X-axis). (d: Mechanism for movement in the direction of Y-axis and a mechanism for detecting the end of lens processing) The Y-axis of the carriage 700 is changed by a pulse motor 728, which is secured to a block 722 in such a way that a round rack 725 meshes with a pinion 730 secured to the rotational shaft 729 of the pulse motor 728. The round rack 725 extends parallel to the shortest line segment connecting the axis of the rotational shaft 717 and that of the shaft 723 secured to the intermediate plate 710; in addition, the round rack 725 is held to be slidable with a certain degree of freedom between a correction block 724 which is rotatably fixed on the shaft 723 and the-block 722. A stopper 726 is fixed on the round rack 725 so that it is capable of sliding only downward from the position of contact with the correction block 724. With this arrangement, the axis-to-axis distance r' between the rotational shaft 717 and the shaft 723 can be controlled in accordance with the rotation of the pulse motor 728 and it is also possible to control the axis-to-axis distance r between the abrasive wheel rotating shaft 61 and each of the lens chucking shafts 704*a* and 704*b* since r has a linear correlationship with r' (see, for example, U.S. Pat. No. 5,347,762).

A hook of a spring 731 is in engagement with the drive plate 716 secured to the carriage 700 and a wire 732 is in engagement with a hook at the other end of the spring 731. A drum is attached to the rotational shaft of a motor 733 secured on the intermediate plate 710 such that the resilient force of the spring 731 can be adjusted by winding up the wire 732. The carriage 700 is pulled by the spring 731 toward the abrasive wheels such that it continues to move in the direction of Y-axis until the stopper 726 contacts the correction block 724. During the lens processing, the carriage 700 is pushed up by the reaction of the abrasive wheels so that the stopper 726 will not contact the correction block 724 until after the end of the necessary processing in the direction of Y-axis which is controlled by the rotation of the pulse motor 728. The contact of the stopper 726 with the correction block 724 is checked by a sensor 727 on the intermediate plate 710 so as to detect the end of lens processing.

(B) Eyeglass Frame and Template Configuration Measuring Device

Figure 4:
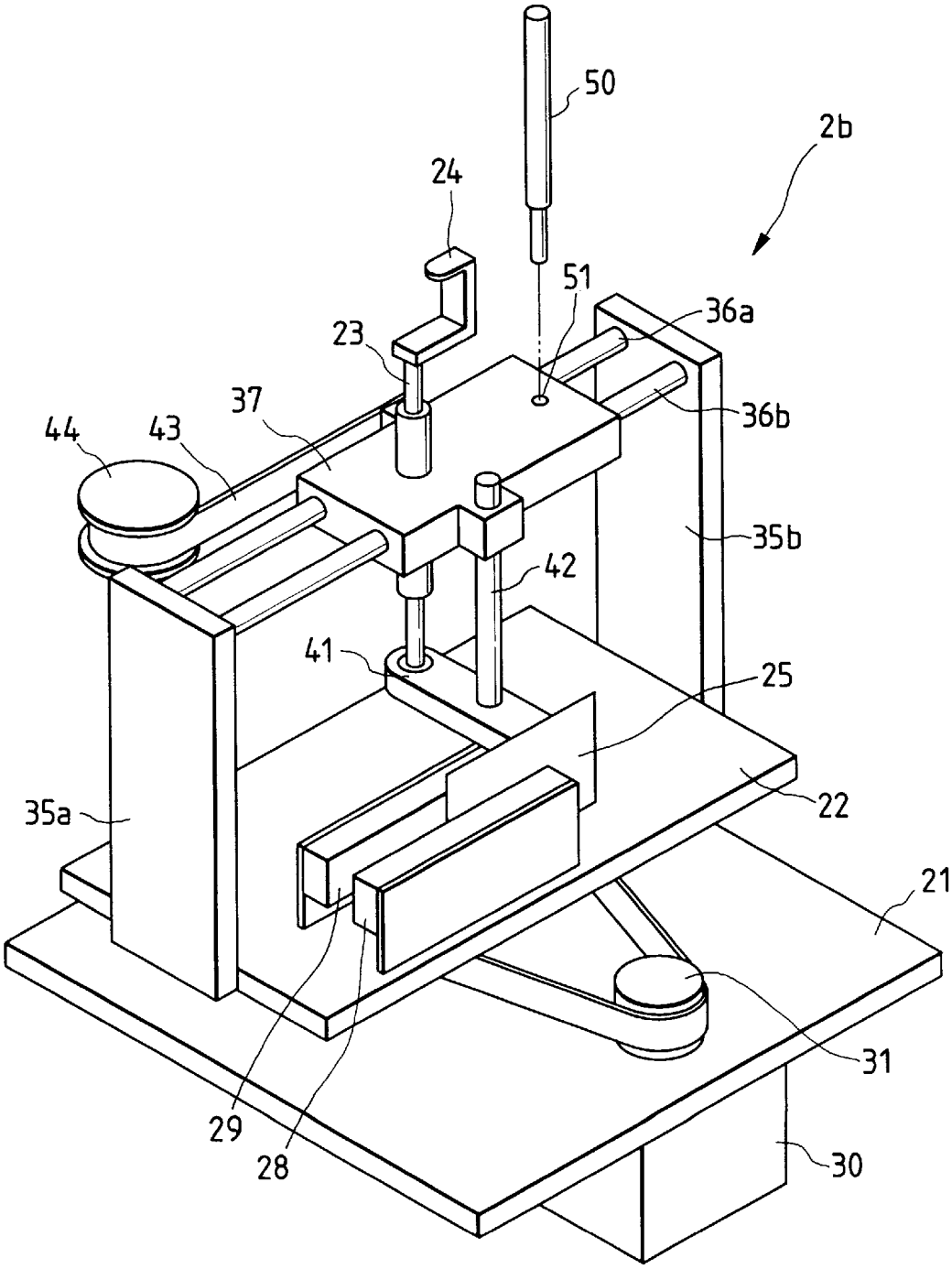
FIG. 4 is a perspective view of the functional part of a lens frame and template configuration measuring device.
Figure 5:
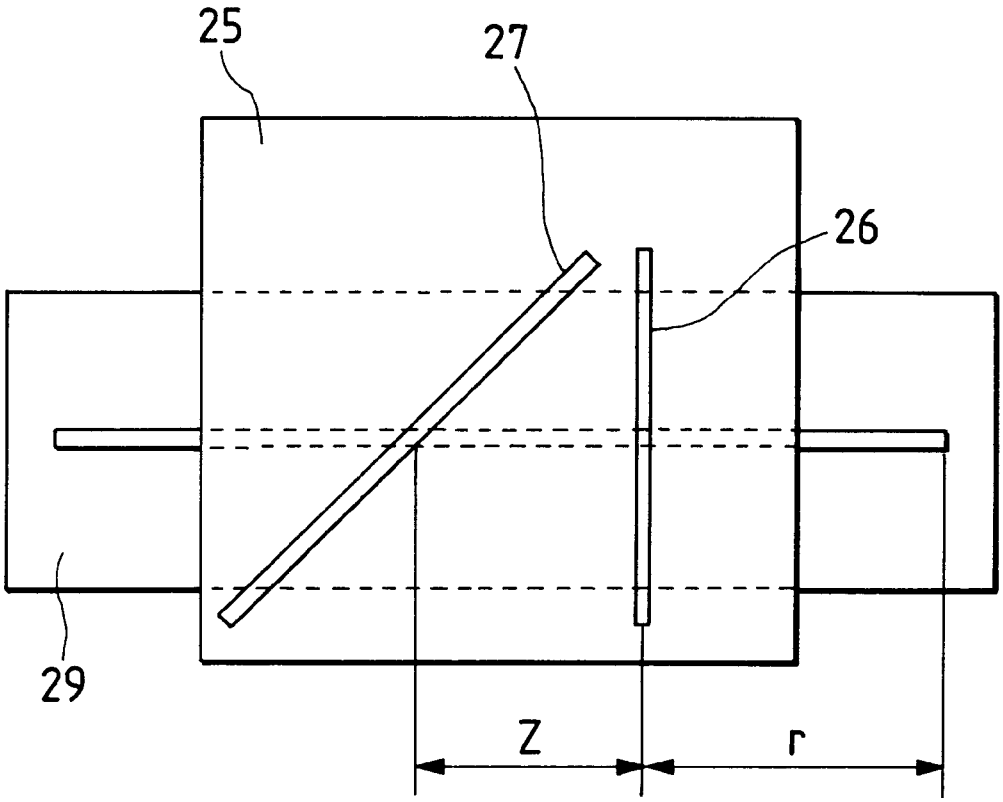
FIG. 5 is a diagram illustrating the positional relationship between the light shielding plate and the linear image sensor in the functional part of a lens frame and template configuration measuring device.

FIG. 4 is a perspective view of the functional part 2*b* of the eyeglass frame and template configuration measuring device 2. The functional part 2*b* comprises a moving base 21 which is movable in a horizontal direction, a rotating base 22 which is rotatably and axially supported on the moving base 21 and which is rotated by a pulse motor 30, a moving block 37 which is movable along two rails 36*a* and 36*b* supported on retainer plates 35*a* and 35*b* provided vertically on the rotating base 22, a gage head shaft 23 which is passed through the center of the moving block 37 in such a way that it is capable of both rotation and vertical movements, a gage head 24 attached to the top end of the gage head shaft 23 such that its distal end is located on the central axis of the shaft 23, an arm 41 which is rotatably attached to the bottom end of the shaft 23 and is fixed to a pin 42 which is rotatably attached to the bottom end of the shaft 23 which extends from the moving block 37 vertically, a light shielding plate 25 which is attached to the distal end of the arm 41 and which has a vertical slit 26 and a 45° inclined slit 27 formed as shown clearly in FIG. 5, a combination of a light-emitting diode 28 and a linear image sensor 29 which are attached to the rotating base 22 to interpose the light shielding plate 25 therebetween, and a constant-torque spring 43 which is attached to a drum 44 rotationally and axially supported on the rotating base 22 and which normally pulls the moving block 37 toward the distal end of the head gage 24.

The moving block 37 also has a mounting hole 51 through which a measuring pin 50 is to be inserted for measurement of the template.

The functional part 2*b* having the construction just described above measures the configuration of the eyeglass frame in the following manner. First, the eyeglass frame is fixed in a frame holding portion (not shown but see, for example, U.S. Pat. No. 5,347,762) and the distal end of the gage head 24 is brought into contact with the bottom of the groove formed in the inner surface of the eyeglass frame. Subsequently, the pulse motor 30 is allowed to rotate in response to a predetermined unit number of rotation pulses. As a result, the gage head shaft 23 which is integral with the gage head 24 moves along the rails 36*a* and 36*b* in accordance with the radius vector of the frame and also moves vertically in accordance with the curved profile of the frame. In response to these movements of the gage head shaft 23, the light shielding plate 25 moves both vertically and horizontally between the LED 28 and the linear image sensor 29 such as to block the light from the LED 28. The light passing through the slits 26 and 27 in the light shielding plate 25 reaches the light-receiving part of the linear image sensor 29 and the amount of movement of the light shielding plate 25 is read. Briefly, the position of slit 26 is read as the radius vector r of the eyeglass frame and the positional difference between the slits 26 and 27 is read as the height information z of the same frame. By performing this measurement at N points, the configuration of the eyeglass frame is analyzed as (rn, θn, zn) (n=1, 2, . . . , N). The eyeglass frame and template configuration measuring device 2 under consideration is basically the same as what is described in commonly assigned U.S. Pat. No. 5,138,770, to which reference should be made.

For measuring a template, the template is fixed on a template holding portion (see, for example, U.S. Pat. No. 5,347,762) and, the measuring pin 50 is fitted in the mounting hole 51. As in the case of measurement of the eyeglass frame configuration, the pin 50 will move along the rails 36*a* and 36*b* in accordance with the radius vector of the template and, hence, the position of slit 26 detected by the linear image sensor 29 is measured as information radius vector.

(C) Lens Configuration Measuring Section

Figure 6:
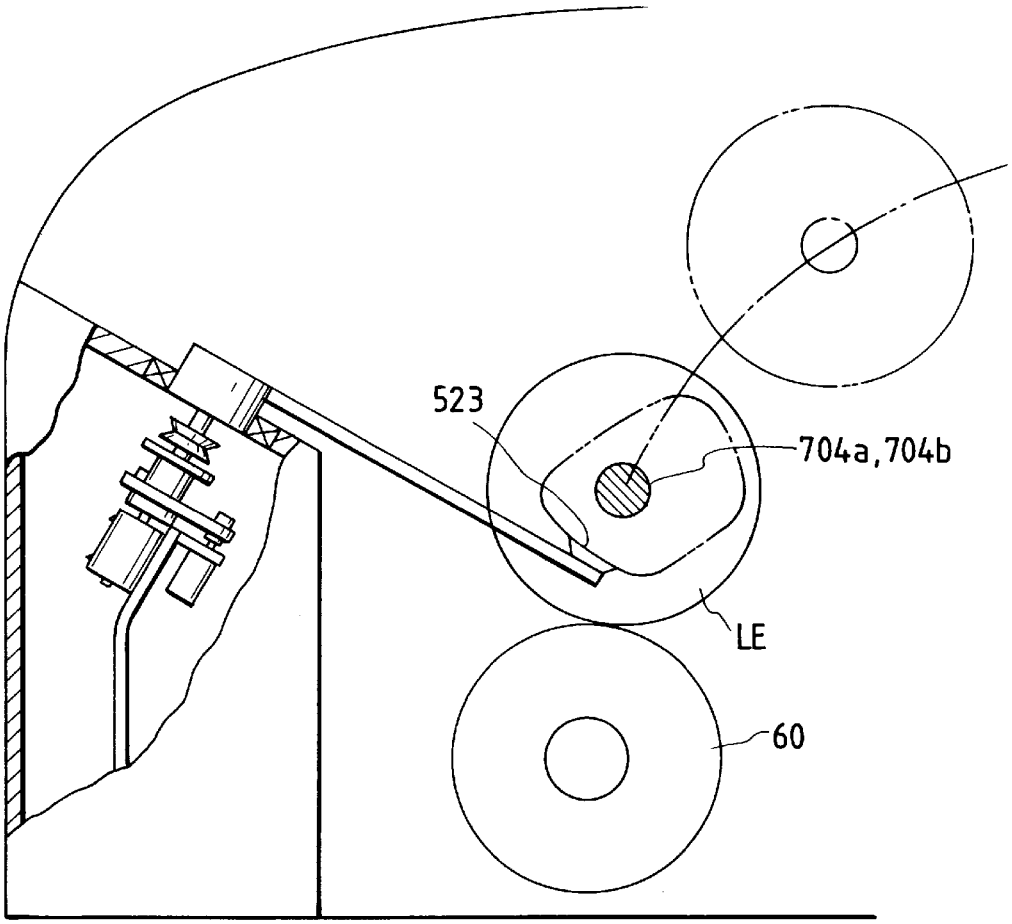
FIG. 6 is a schematic diagram showing the general layout of an lens configuration measuring section.
Figure 7:
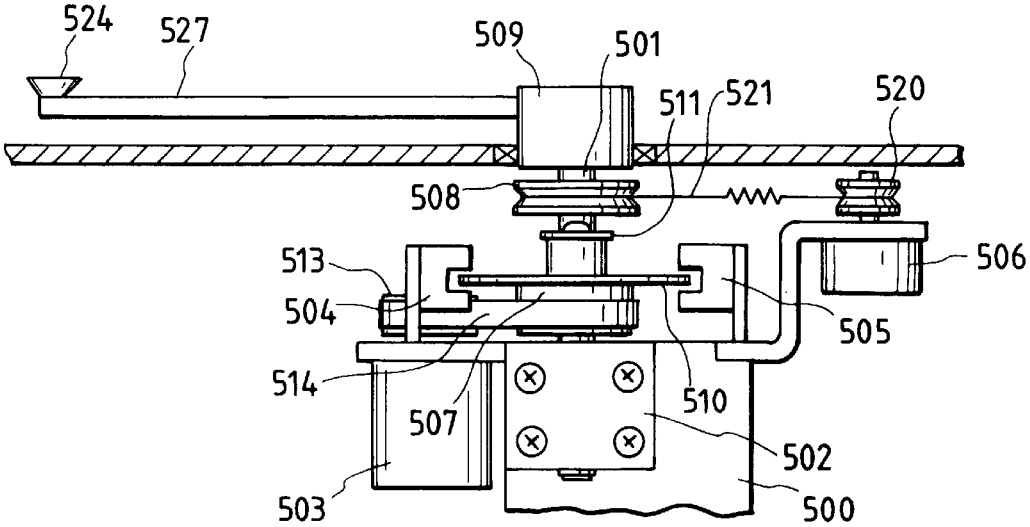
FIG. 7 is a sectional view of the lens configuration measuring section.
Figure 8:
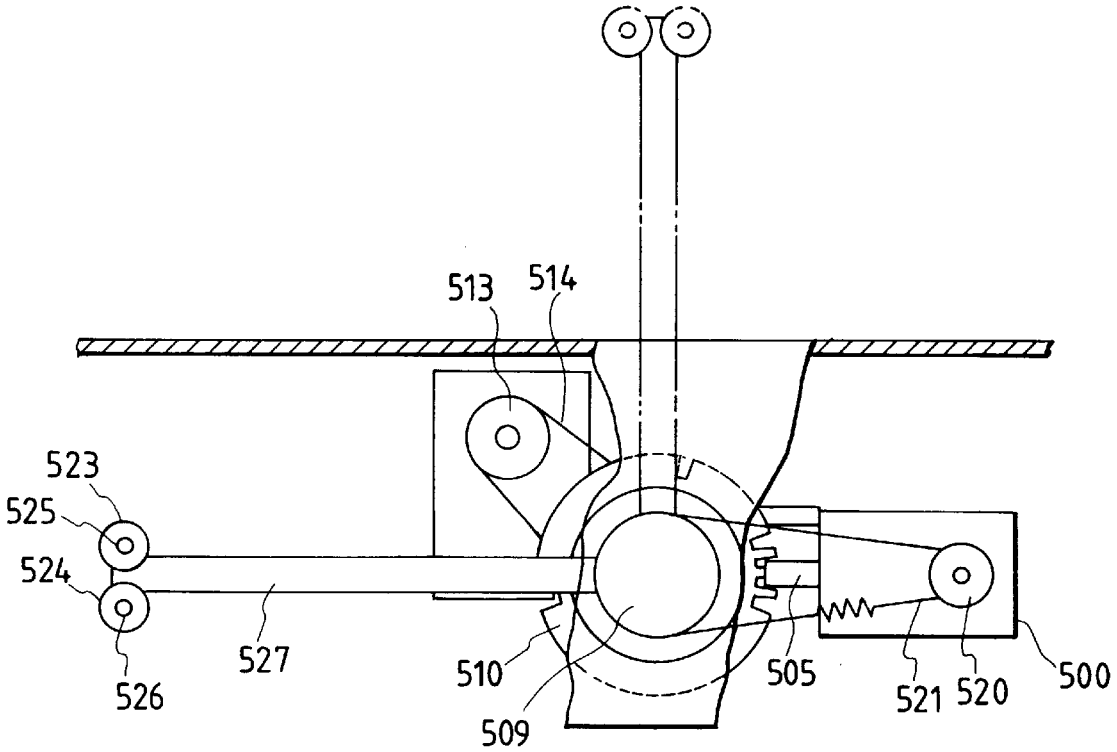
FIG. 8 is a plan view illustrating the lens configuration measuring section.

FIG. 6 is a schematic diagram showing the general layout of the lens configuration measuring section; FIG. 7 is a sectional view of this section, and FIG. 8 is a plan view of the same.

A shaft 501 is rotatably mounted on a frame 500 through a bearing 502. Also mounted on the frame 500 are a DC motor 503, photoswitches 504 and 505 and a potentiometer 506. A pulley 507 is rotatably mounted on the shaft 501. Also mounted on the shaft 501 are a pulley 508 and a flange 509. A sensor plate 510 and a spring 511 are-mounted on the pulley 507.

Figure 9:
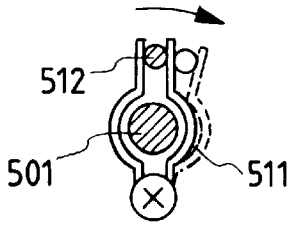
FIG. 9 is a diagram illustrating the action of a spring relative to a pin.

As shown in FIG. 9, the spring 511 is attached to the pulley 508 such that it holds a pin 512 in position. As a result, when the spring 511 rotates together with the pulley 507, a resilient force is exerted on the pin 512 to rotate it (the pin 512 is attached to the rotatable pulley 508). If the pin 512 rotates independently of the spring 511, for example, in the direction of the arrow, the resilient force of the spring 511 will work to restore the pin 512 to its initial position.

A pulley 513 is attached to the rotational shaft of the motor 503 and the rotation of the motor 503 is transmitted to the pulley 507 via a belt 514 stretched between the pulleys 513 and 507. The rotation of the motor 503 is detected and controlled-by the photoswitches 504 and 505 with the aid of the sensor plate 510 attached to the pulley 507.

Rotation of the pulley 507 causes the rotation of the pulley 508 to which the pin 512 is attached and the rotation of the pulley 508 is detected by the potentiometer 506 through a rope 521 stretched between the pulley 508 and a pulley 520 which is attached to the rotational shaft of the potentiometer 506. In this case, the shaft 501 and the flange 509 rotate simultaneously with the rotation of the pulley 508.

Feelers 523 and 524 are rotatably mounted on a measurement arm 527 by means of pins 525 and 526, respectively, with the measurement arm 527 being attached to the flange 509. The photoswitch 504 detect the initial position of the measurement arm 527 and the measurement complete position thereof. The photoswitch 505 detects the relief position and the measurement position of each feeler with respect to both the front and rear refractive surfaces of the lens.

In the process of measuring the lens profile (configuration), the lens is revolved with the feeler 523 contacting its front refractive surface (the feeler 524 contacting the rear refractive surface), whereby the potentiometer 506 detects the amount of rotation of the pulley 508 to provide data on the lens configuration.

(D) Display Section and Input Section

Figure 10:
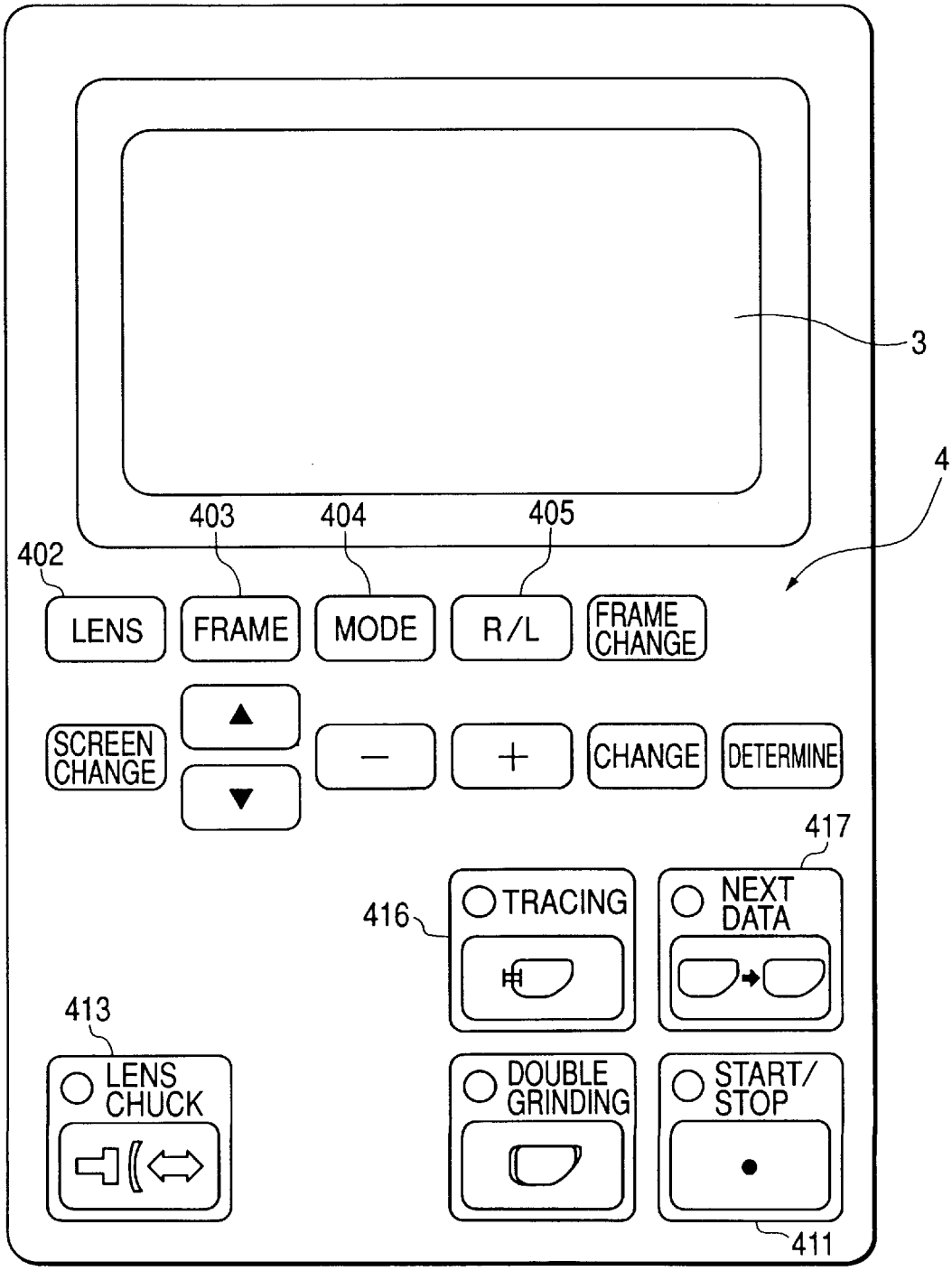
FIG. 10 is a diagram showing the outer appearance of the display and input sections of the grinding machine.

FIG. 10 is a diagram showing the outer appearance of the display section 3 and the input section 4, which are formed into an integral unit. The input section 4 includes various setting switches such as a lens switch 402 for distinguishing either of plastics and glass as the constituent material of the lens to be processed, a frame switch 403 for distinguishing between resins and metals as the constituent material of the frame, a mode switch 404 for selecting the mode of lens processing to be performed (whether it is tapered edge (bevel) processing, plane processing or plano-specular processing(polishing)), a R/L switch 405 for determining whether the lens to be processed is for use on the right eye or the left eye, a START/STOP switch 411 for starting or stopping the lens processing operation, a switch 413 for opening or closing the lens chucks, a tracing switch 416 for giving directions on the eyeglass frame and template tracing, and a next-data switch 417 for transferring the data measured with the eyeglass frame and template configuration measurement device 2.

The display section 3 is formed of a liquid-crystal display and, under the control of a main arithmetic control circuit to be described later, it displays various settings of processing information, the tapered edge (bevel) simulation of the position of a tapered edge (bevel) and the condition of its fitting with the eyeglass frame, as well as reference settings and so forth.

Figure 11:
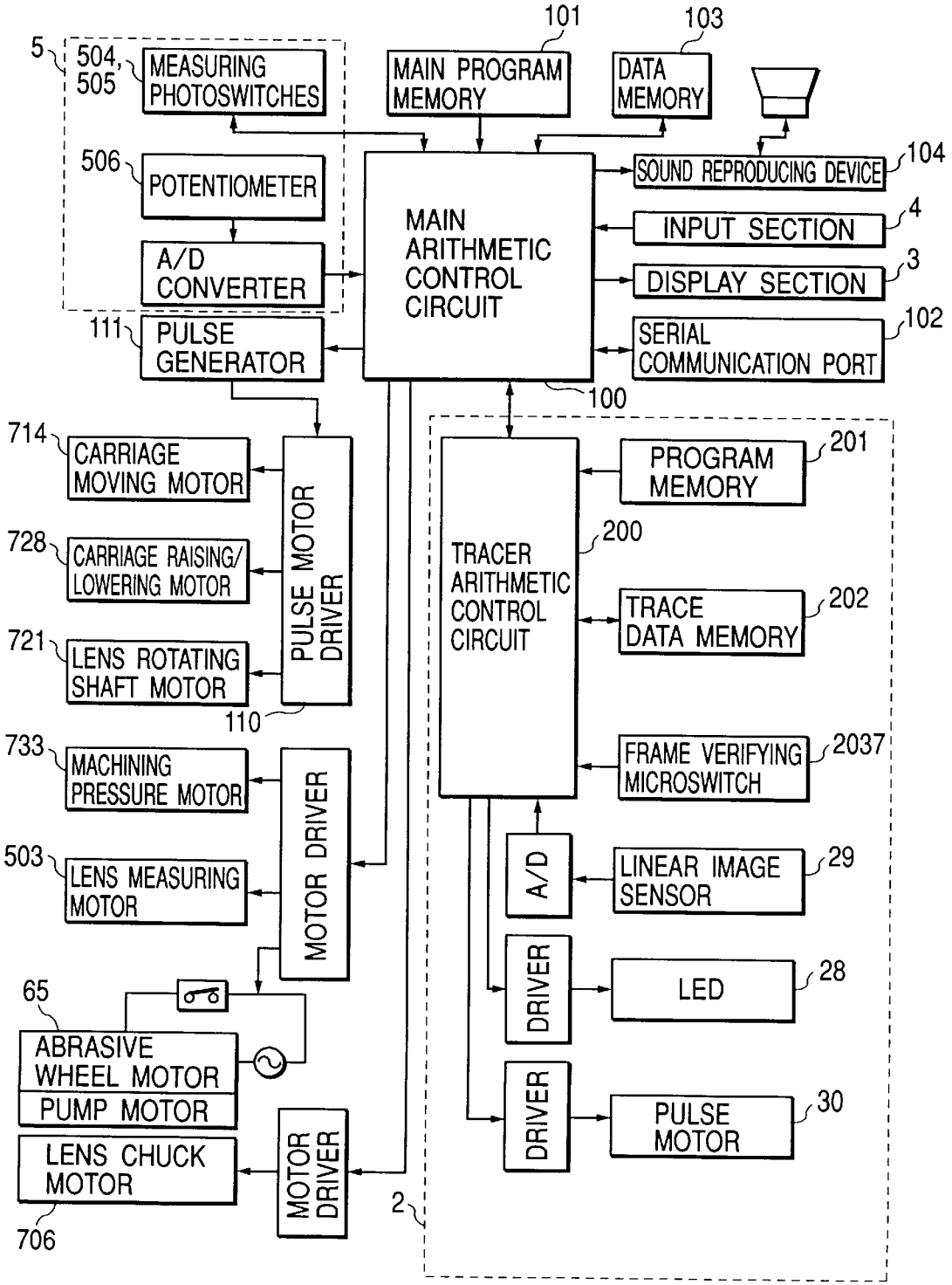
FIG. 11 shows the essential part of a block diagram of the electronic control system for the grinding machine.

(E) Electronic Control System for the Machine FIG. 11 shows the essential part of a block diagram of the electronic control system for the eyeglass lens grinding machine of the invention. A main arithmetic control circuit 100 which is typically formed of a microprocessor and controlled by a sequence program stored in a main program memory 101. The main arithmetic control circuit 100 can exchange data with IC cards, eye examination-devices and so forth via a serial communication port 102. The main arithmetic control circuit 100 also performs data exchange and communication with a tracer arithmetic control circuit 200 of the eyeglass frame and template configuration measurement device 2. Data on the eyeglass frame configuration are stored in a data memory 103.

The display section 3, the input section 4, a sound reproducing device 104, as well as the photoswitches 504 and 505, the DC motor 503 and the potentiometer 506 as functional components of the lens configuration measuring device 5 are connected to the main arithmetic control circuit 100. The potentiometer 506 is connected to an A/D converter and the result of conversion is fed into the main arithmetic control circuit 100. The measured data of lens which have been obtained by arithmetic operations in the main arithmetic control circuit 100 are stored in the data memory 103. The carriage moving motor 714, as well as the pulse motors 728 and 721 are connected to the main arithmetic control circuit 100 via a pulse motor driver 110 and a pulse generator 111. The pulse generator 111 receives commands from the main arithmetic control circuit 100 and determines how many pulses are to be supplied at what frequency in Hz to the respective pulse motors to control their operation.

Figure 12:
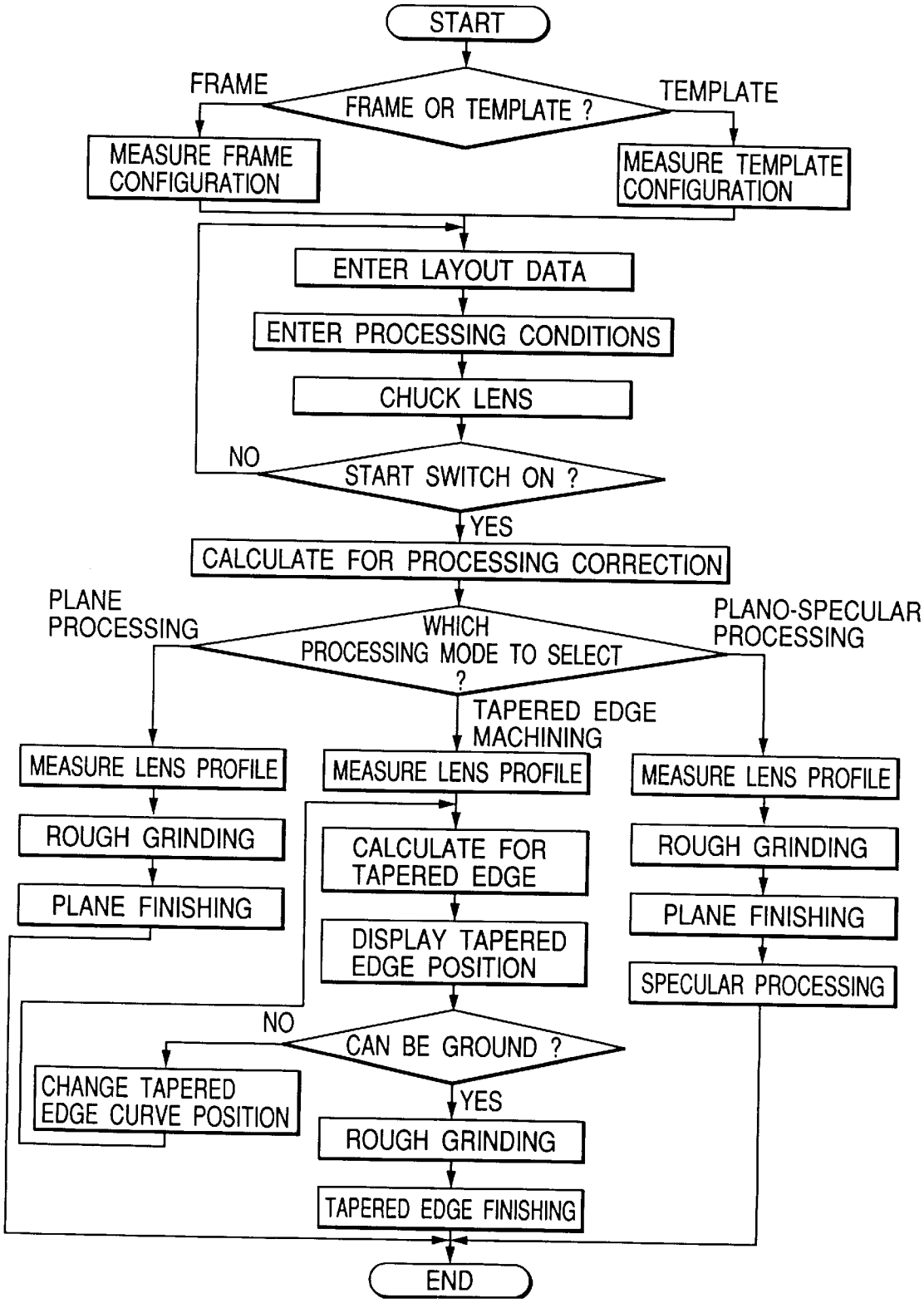
FIG. 12 is a flowchart for explaining the operation of the grinding machine.

The operation of the eyeglass lens grinding machine having the above-described construction will now be explained with reference to the flowchart shown in FIG. 12. In the first place, an eyeglass frame (or a template therefor) is set on the eyeglass frame and template configuration measuring device 2 and the tracing switch 416 is touched to start tracing. The radius vector information on the eyeglass frame as obtained by the functional part 2*b* is stored in a trace data memory 202. When the next data switch 417 is touched, the data obtained by tracing is transferred into the machine and stored in the data memory 103. At the same time, graphics in the form of a frame is presented on the screen of the display section 3 on the basis of the eyeglass frame data, rendering the machine ready for the entry of processing conditions. It should be noted that the data to be stored in the data memory 103 may be the one from storage media such as IC cards or it may be transferred on-line from a separately connected computer.

In the next step, the operator who is looking at the screen of the display section 3 operates on the input section 4 to enter layout data such as the PD, the FPD and the height of the optical center. Subsequently, the operator determines what the lens to be processed and the frame are made of and as to whether the lens to be processed is for use on the right or left eye and enters the necessary data. In addition, the operator touches the mode switch 404 to select the necessary processing mode (whether it is for tapered edge (bevel) processing, plane processing or plano-specular processing (polishing)). On the pages that follow, the operation of the machine in two different modes, tapered edge (bevel) processing and plano-specular processing (polishing) will be described.

Tapered Edge (Bevel) Machining Mode

After entering the processing conditions, the lens to be processed is subjected to specified preliminary operations (e.g., centering of the suction cup) and chucked between the lens rotating shafts 704*a* and 704*b*. Then, the START/STOP switch 411 is touched to activate the machine.

In response to the entry of a start signal, the machine performs arithmetic operations to effect processing correction (the correction of the radius of each abrasive wheel) on the basis of the entered data (see, for example, U.S. Pat. No. 5,347,762) and subsequently measures the profile (configuration) of the lens by the following procedure. First, the lens rotating shaft motor (the pulse motor) 721 is run to rotate the lens rotating shafts 704*a* and 704*b* such that the radius vector angle $r_s\theta_n$ in the radius vector information ($r_s\delta_n$, $r_s\theta_n$) from the data on the eyeglass frame configuration is directed to the center of revolution of the abrasive wheels. In the next step, the carriage moving motor 714 on the carriage 700 is run to move the carriage 700 to the reference position for measurement which is at the left end of the carriage stroke. Thereafter, the lens configuration measuring device 5 is used to measure the profiles (configuration) of the front and rear refractive surfaces of the lens on the basis of the radius vector information.

When the profile (edge position) of the lens to be processed is obtained, the tapered edge (bevel) is then established on the basis of that profile (edge position). To this end, data for tapered edge processing is obtained by performing the necessary calculations for determining the locus (position) of the tapered edge (bevel) apex. Various methods may be employed to calculate the position of the tapered edge (bevel) apex, such as determining a certain ratio on the basis of the edge thickness of the lens or shifting the position of the tapered edge (bevel) apex from the edge position of the front surface of the lens by a certain amount toward the rear surface of the lens and establishing the tapered edge curve (bevel curve) which is the same as the curve of the front surface of the lens (see, for example, U.S. Pat. No. 5,347,762).

When the calculations for determining the locus (position) of the tapered edge (bevel) apex are complete, the tapered edge (bevel) profile in the position for a minimal edge thickness is presented on the display section 3 in juxtaposition with the presentation of the frame profile (configuration) 31 (the edge position can be moved around). The operator checks the displayed profile of the tapered edge (bevel) and, if there is no problem, he touches the START/STOP switch 411 again to start tapered edge (bevel) processing (needless to say, the tapered edge (bevel) processing operation can be started without retouching the START/STOP switch 411).

On the basis of the data on the eyeglass frame configuration and the processing data obtained by the tapered edge (bevel) calculations, the machine controls the carriage section 7 and the lens grinding section 6 to perform rough grinding. According to the entered data on the material of the lens, the machine drives the motor carriage moving 714 and moves the carrier 700 such that the lens will be positioned right above the specified rough abrasive wheel. Then, the abrasive wheel group 60 is rotated and, at the same time, the pulse motor 728 is run to vary the Y-axis. The amount by which the Y-axis is to be varied is determined on the basis of the data for lens processing and the main arithmetic control circuit 100 drives the pulse motor 728 such that the lens will be ground to have the desired profile (configuration). The lens is ground with the rough abrasive wheel onto which it is pressed under the resilient force of the spring 731. The main arithmetic control circuit 100 first supplies the pulse motor 728 with a Y-axis varying signal at the reference position for rotation and then drives the pulse motor 721 to rotate the lens through a small angle. Simultaneously and in synchronism with this action, the main arithmetic control circuit 100 supplies the pulse motor 728 with an operation signal which varies the Y-axis on the basis of the data for lens processing. Thus, by rotating the lens through small angles on the basis of the data for lens processing, the main arithmetic control circuit 100 controls the movement of the Y-axis continually in succession until the lens is ground to have the intended profile (configuration).

During the grinding operation, the lens is urged against the rough abrasive wheel by the resilient force of the spring 731 and yet relief is provided to ensure that it will not be depressed excessively by the above-described mechanism for movement in the direction of Y-axis. At successive positions of small angles, the sensor 727 checks if the intended grinding has ended. For those portions of the lens which are yet to be completely ground to the desired profile (configuration) on account of the relief provided by the spring 731, the sensor 727 turns off. As the lens rotates, the grinding step becomes complete in several portions of the lens. When the end of processing is verified at the positions reached by successive resolutions through small angles, the main arithmetic control circuit 100 controls the drive of the pulse motor 721 such that the lens (i.e., the lens rotating shafts 704*a* and 704*b*) will revolve faster than the speed of normal processing. The next time it becomes impossible for the sensor 727 to verify the end of processing, the main arithmetic control circuit 100 returns the lens rotating speed to the speed of normal processing. Thus, the sensor 727 checks for the end of lens processing at each radius vector angle on the basis of the processing data and depending upon the result of the checking, the main arithmetic control circuit 100 varies the lens rotating speed and causes the lens to rotate fully once for grinding.

If there still remain several portions of the lens that cannot be found to have been completely processed after it has revolved fully once, the lens is allowed to make another rotation. In this case, an increased part of the lens has been processed so that by causing the processed portions of the lens to rotate at faster speed, the lens processing can be performed within a shorter time than when the lens is rotated at a constant speed throughout the grinding operation. When the end of processing has been verified for the entire periphery of the lens after it has rotated through successive small angles, the lens has been ground to the intended profile (configuration), except for the allowance for the finishing operation, on the basis of the processing data.

After the end of the rough grinding, the process goes to the finishing operation. By means of the motor 728, the lens is disengaged from the rough abrasive wheel and the Y-axis is returned to the origin; thereafter, the carriage moving motor 714 is run to move the X-axis such that the tapered edge forming groove (bevel processing groove) on the outer periphery of the finishing abrasive wheel 60*c* become identical in position to the data for tapered edge (bevel) processing. Subsequently, the Y-axis is moved such that the lens is pressed onto the finishing abrasive wheel 60*c* for performing tapered edge (bevel) processing. In tapered edge (bevel) processing, the machine controls Y- and X-axes simultaneously by means of the pulse motors 728 and 714, respectively, through successive small angles on the basis of the data for tapered edge (bevel) processing. As in the rough grinding step, the lens is ground with the finishing abrasive wheel 60*c* onto which it is pressed under the resilient force of the spring 731 and at successive positions of small angles, the sensor 727 checks if the intended processing has ended. If the end of processing is verified, the pulse motor 721 is controlled such that the lens rotates faster than the speed of normal processing; on the other hand, it becomes no longer possible to verify the end of processing, the lens rotating speed is returned to the speed of normal processing. In this way, the processed portions of the lens are rotated faster than the unprocessed portions not only in the rough grinding step but also in the finishing step, thereby contributing to the reduction of the total lens processing time.

Figure 13:
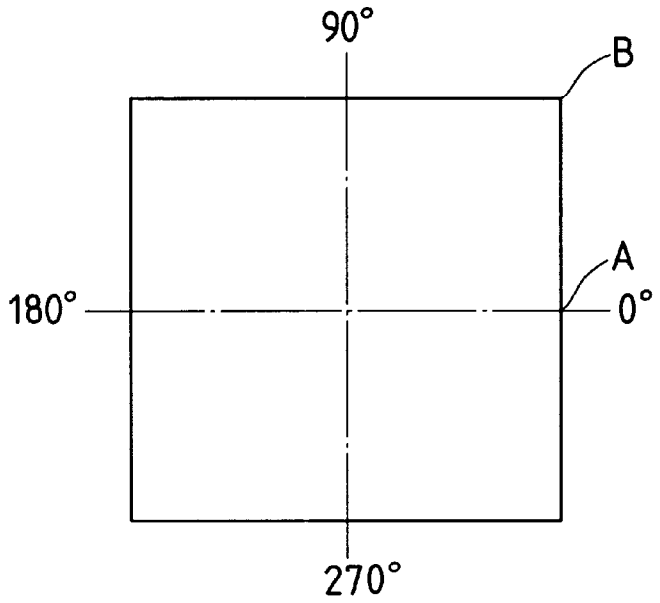
FIG. 13 shows an exemplary lens configuration for explaining the speed at which the point of contact between a lens and an abrasive wheel moves.
Figure 14:
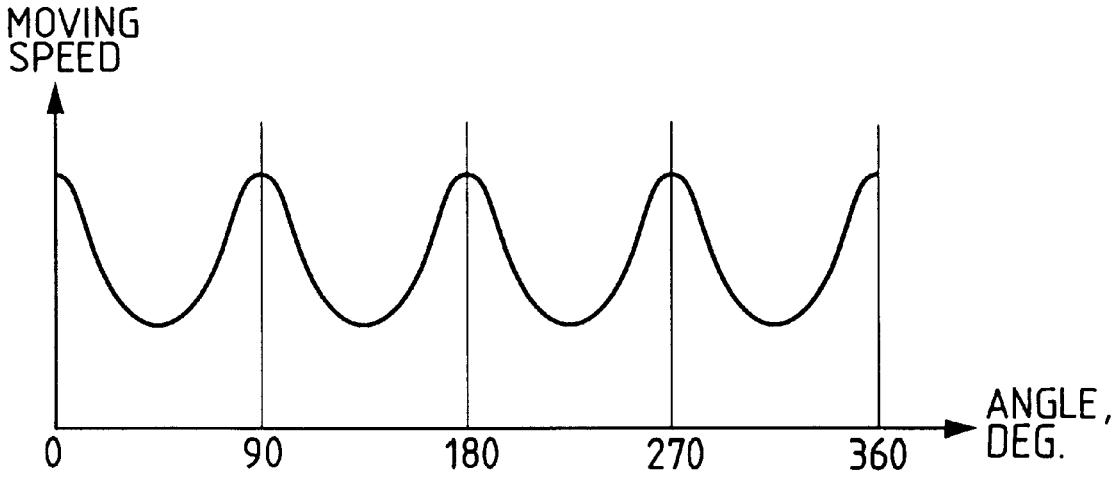
FIG. 14 is a diagram showing how the angle of rotation of a lens having the profile shown in FIG. 13 is related to the speed at which the point of its contact with an abrasive wheel moves.

In the finishing operation, the machine makes another control such that the lens rotating speed is varied in a manner dependent upon the speed at which the point of contact between the intended lens profile (configuration) and the finishing abrasive wheel 60*c* moves. Consider, for example, the case of grinding the lens to the square shown in FIG. 13; if the lens is rotated at a constant speed, the speed of movement relative to the point of contact with the finishing abrasive wheel 60*c* will be the fastest at a point near the center of a straight line, as indicated by point A in FIG. 14. If the speed of movement at the point of contact is too fast, an increased portion of the lens tends to remain unremoved in the nearby area. Conversely, the speed of movement is extremely slow at a corner of the square (near point B). If the speed of movement is unduly slow, the processing time is so much increased as to deteriorate the operating efficiency. To avoid these problems, the lens grinding machine in the embodiment under discussion does not employ a constant lens rotational speed but allows the lens to rotate at varying speeds in accordance with the speed at which the point of contact between the intended lens profile (configuration) (i.e., the lens profile to be obtained by processing) and the finishing abrasive wheel 60*c* moves. In a typical case, the lens rotating speed is controlled such that the point of its contact with the finishing abrasive wheel 60*c* will move at a constant speed or at a speed progressively approaching a fixed value. This method is effective in ensuring that the least part of the lens will remain unremoved while shortening the total processing time. The speed of movement under consideration should be set at an appropriate value by taking into account various conditions in order to ensure that the amount of the lens which remains unremoved is within allowable limits. It should also be noted that the speed of movement of the point of contact between the intended lens profile (configuration) and the finishing abrasive wheel 60*c* can be determined on the basis of the distance between individual data involving ($r_s\delta_n$, $r_s\theta_n$) such as the data for tapered edge (bevel) processing and the eyeglass frame configuration data.

Plane-specular Processing (polishing) Mode

The case where a plane-specular processing (polishing) mode is selected will be described. As in the above-described tapered edge (bevel) processing, the lens is chucked and the switch 411 is touched, whereupon the machine performs calculations for processing correction and measures the lens configuration. Subsequently, the machine performs rough grinding. As in the tapered edge (bevel) processing mode, the rough grinding operation is checked for the end of processing at each radius vector angle on the basis of the processing data and depending upon the result of the checking, the speed of lens rotation is varied.

After the end of the rough grinding, the process goes to the finishing operation. As in the tapered edge (bevel) processing mode, the rotating speed of the lens is controlled in accordance with the speed at which the point of contact between the lens and the finishing abrasive wheel 60*c* moves; as a result, it is ensured that the least part of the lens will remain unremoved and yet the total processing time is shortened.

The next step is specular processing (polishing). The carriage is moved such that the lens is positioned above the specular processing (polishing) abrasive wheel 60*d* and the movement of the Y-axis is controlled on the basis of the processing data such that the lens is pressed onto the abrasive wheel 60*d*. In the specular processing (polishing), the rotating speed of the lens is controlled on the basis of the variation in the edge thickness data as obtained by the above-described measurement of the lens configuration, such that the rotating speed decreases as the edge thickness increases. This is effective in eliminating any unevenness from the surface being processed, to thereby provide a uniform finished lens surface. Conversely, the rotating speed of the lens may be increased with the decreasing edge thickness. In this alternative case, the specular processing time can be shortened.

The embodiment described above can be modified in various ways. For example, in addition to the control that is performed in rough grinding by increasing the lens rotating speed when the abrasive wheel passes by the already processed portion of the lens, the lens rotation may be controlled in such a way that the speed of movement of the lens and abrasive wheel will made constant in the area of the lens which is to be ground with the abrasive wheel. Further, the basic control may be combined with another control for varying the speed of lens rotation in accordance with the variation in the edge thickness of the lens. It should also be noted that these controls may be combined in various ways not only in rough grinding but also in the finishing step of tapered edge (bevel) processing and plane processing. More conveniently, these controls for varying the speed of lens rotation may be combined in consideration of various conditions for lens grinding, including the material of the lens to be processed, the stage of processing to be performed and the need to perform double grinding.

As described on the foregoing pages, the present invention eliminates needless actions from the lens grinding operation to thereby achieve an improvement in the processing speed.

Additional improvements in processing are realized by rotating the lens in a manner dependent upon the speed at which the point of contact with the abrasive wheel moves, as well as on the edge thickness of the lens.

What is claimed is:

1. An eyeglass lens grinding machine for grinding a periphery of a lens to fit into an eyeglass frame, comprising:

processing means for processing the periphery of the lens using a rotating abrasive wheel;

lens rotating means for holding and rotating the lens;

configuration data inputting means for entering configuration data on the eyeglass frame or a template therefor;

layout data inputting means for entering data to be used in providing a layout of the lens corresponding to the eyeglass frame;

processing data calculating means for calculating processing data on the basis of the data entered by said configuration data inputting means and said layout data inputting means;

axis-to-axis distance control means for controlling an axis-to-axis distance between an axis about which the abrasive wheel is rotated and an axis about which the lens is rotated on the basis of said processing data;

edge position detecting means for detecting an edge position on each of front and rear surfaces of the lens, which is expected after completion of rough processing or finish processing, on the basis of said processing data;

edge thickness calculating means for obtaining an edge thickness of the lens on the basis of the edge position thus detected; and rotation control means for controlling a rotational speed of said lens rotating means on the basis of the edge thickness thus obtained so that the rotational speed of the lens is slower as the edge thickness is larger.

2. An eyeglass lens grinding machine for processing a lens by grinding a periphery of the lens to fit into an eyeglass frame, comprising:

lens rotating means for holding and rotating the lens to be processed;

configuration data inputting means for entering configuration data on said eyeglass frame or a template therefor;

layout data inputting means for entering data to be used in providing a layout of the lens corresponding to said eyeglass frame;

processing data calculating means for calculating processing data on the basis of the data entered by said configuration data inputting means and said layout data inputting means;

rotational speed varying means, provided for at least partial processing of the lens, for varying a rotational speed of said lens rotating means in accordance with an amount of processing relative to an angle of lens rotation;

control means for controlling the processing of the lens on the basis of the processing data obtained by said processing data calculating means; and detection means for detecting a processed portion of the lens during the processing, and wherein said rotational speed varying means varies the rotational speed of said lens rotating means faster for the processed portion of the lens than for the yet to be processed portion on the basis of the result of detection by said detection means.

3. An eyeglass lens grinding machine for processing a lens by grinding a periphery of the lens to fit into an eyeglass frame, comprising:

lens rotating means for holding and rotating the lens to be processed;

configuration data inputting means for entering configuration data on said eyeglass frame or a template therefor;

layout data inputting means for entering data to be used in providing a layout of the lens corresponding to said eyeglass frame;

processing data calculating means for calculating processing data on the basis of the data entered by said configuration data inputting means and said layout data inputting means;

rotational speed varying means, provided for at least partial processing of the lens, for varying a rotational speed of said lens rotating means in accordance with an amount of processing relative to an angle of lens rotation;

control means for controlling the processing of the lens on the basis of the processing data obtained by said processing data calculating means; and speed calculating means for calculating a moving speed, at which a point of contact between the lens and an abrasive wheel moves during processing, on the basis of the processing data obtained by said processing data calculating means, and wherein said rotational speed varying means varies the rotational speed of said lens rotating means in accordance with the moving speed obtained by said speed calculating means.

4. The eyeglass lens grinding machine according to claim 3, wherein said rotational speed varying means varies the rotational speed of said lens rotating means during at least one of specular processing and tapered edge processing.

5. An eyeglass lens grinding machine for grinding a periphery of a lens to fit into an eyeglass frame, comprising:

lens rotating means for holding and rotating the lens to be processed;

configuration data inputting means for entering configuration data on said eyeglass frame or a template therefore;

layout inputting means for entering data to be used in providing a layout of the lens corresponding to said eyeglass frame;

edge thickness detection means for detecting an edge thickness of the lens on the basis of the data entered by said configuration data inputting means and said layout data inputting means;

processing data calculating means for calculating processing data on the basis of the data entered by said edge thickness detection means, said configuration data inputting means and said layout data inputting means;

rotational speed varying means, provided for at least partial processing of the lens, for varying the rotational speed of said lens rotating means in accordance with the amount of processing relative to an angle of lens rotation; and control means for controlling to process the lens on the basis of the processing data obtained by said processing data calculating means.

6. The eyeglass lens grinding machine according to claim 5, further comprising:

detection means for detecting a processed portion of the lens during processing, and wherein said rotational speed varying means varies the rotational speed of said lens rotating means faster for the processed portion of the lens than for the yet to be processed portion, on the basis of the result of detection by said detection means.

7. The eyeglass lens grinding machine according to claim 5, further comprising: speed calculating means for calculating a moving speed, at which a point of contact between the lens and an abrasive wheel moves during processing, on the basis of the processing data obtained by said processing data calculating means, and wherein said rotational speed varying means varies the rotational speed of said lens rotating means in accordance with the moving speed obtained by said speed calculating means.

8. The eyeglass lens grinding machine according to claim 7, wherein said rotational speed varying means varies the rotational speed of said lens rotating means so that the point of contact between the abrasive wheel and the lens moves at a generally constant speed.

9. The eyeglass lens grinding machine according to claim 8, wherein said rotational speed varying means varies the rotational speed of said lens rotating means during at least one of specular processing and tapered edge processing so that the point of contact between the abrasive wheel and the lens moves at the generally constant speed.

10. The eyeglass lens grinding machine according to claim 5, wherein said rotational speed varying means varies the rotational speed of said lens rotating means on the basis of edge thickness information obtained by the said edge thickness detection means.

11. An eyeglass lens grinding machine for grinding a periphery of a lens to fit into an eyeglass frame, comprising:

a lens grinding section which processes the periphery of the lens using a rotating abrasive wheel;

a carriage which holds and rotates the lens;

a configuration data input section to allow entry of configuration data on the eyeglass frame or a template therefor;

a layout data input section to allow entry of data to be used in providing a layout of the lens corresponding to the eyeglass frame;

a control circuit which calculates processing data on the basis of the data entered by said configuration data input section and said layout data input section;

a control mechanism which controls axis-to-axis distance between an axis about which the abrasive wheel is rotated and an axis about which the lens is rotated on the basis of said processing data;

a detector which detects a processed portion of the lens during the processing; and a lens rotation controller which controls a rotational speed of said carriage on the basis of a result of detection by said detector such that the rotational speed of said carriage is faster for the processed portion of the lens than for the yet to be processed portion.

12. An eyeglass lens grinding machine for grinding a periphery of a lens to fit into an eyeglass frame, comprising:

a lens grinding section which processes the periphery of the lens using a rotating abrasive wheel;

a carriage which holds and rotates the lens;

a configuration data input section to allow entry of configuration data on the eyeglass frame or a template therefor;

a layout data input section to allow entry of data to be used in providing a layout of the lens corresponding to the eyeglass frame;

a control circuit which calculates processing data on the basis of the data entered by said configuration data input section and said layout data input section;

a control mechanism which controls axis-to-axis distance between an axis about which the abrasive wheel is rotated and an axis about which the lens is rotated on the basis of said processing data;

a moving speed calculator which calculates a moving speed, at which a point of contact between the lens and the abrasive wheel moves during processing, on the basis of said configuration data or said processing data; and a lens rotation controller which controls a rotational speed of said carriage on the basis of the thus calculated moving speed so that an actual speed at which the point of contact moves is made generally constant.

13. An eyeglass lens grinding machine for grinding a periphery of a lens to fit into an eyeglass frame, comprising:

processing means for processing the periphery of the lens using a rotating abrasive wheel;

lens rotating means for holding and rotating the lens;

configuration data inputting means for entering configuration data on the eyeglass frame or a template therefor;

layout data inputting means for entering data to be used in providing a layout of the lens corresponding to the eyeglass frame;

processing data calculating means for calculating processing data on the basis of the data entered by said configuration data inputting means and said layout data inputting means;

axis-to-axis distance control means for controlling an axis-to-axis distance between an axis about which the abrasive wheel is rotated and an axis about which the lens is rotated on the basis of said processing data;

detection means for detecting a processed portion of the lens during the processing; and rotation control means for controlling a rotational speed of said lens rotating means on the basis of a result of detection by said detection means such that the rotational speed of said lens rotating means is faster for the processed portion of the lens than for the yet to be processed portion.

14. An eyeglass lens grinding machine according to claim 13, further comprising:

an edge thickness inputting means for entering an edge thickness of the lens, wherein said rotation control means sets a reference rotational speed of said lens rotating means on the basis of the entered edge thickness so that the rotational speed of the lens is slower as the edge thickness is larger.

15. An eyeglass lens grinding machine according to claim 13, further comprising:

edge position detecting means for detecting an edge position on each of a front and rear surface of the lens, which is expected after completion of rough processing or finish processing, on the basis of said processing data;

edge thickness calculating means for obtaining an edge thickness of the lens on the basis of the edge position thus detected;

wherein said rotation control means controls the rotational speed of said lens rotating means on the basis of the edge thickness thus obtained so that the rotational speed of the lens is slower as the edge thickness is larger.

16. An eyeglass lens grinding machine according to claim 13, wherein said detection means detects an end of processing for the lens during rough processing, and said rotation control means controls the rotational speed of said lens rotating means during the rough processing.

17. An eyeglass lens grinding machine for grinding a periphery of a lens to fit into an eyeglass frame, comprising:

processing means for processing the periphery of the lens using a rotating abrasive wheel;

lens rotating means for holding and rotating the lens;

configuration data inputting means for entering configuration data on the eyeglass frame or a template therefor;

layout data inputting means for entering data to be used in providing a layout of the lens corresponding to the eyeglass frame;

processing data calculating means for calculating processing data on the basis of the data entered by said configuration data inputting means and said layout data inputting means;

axis-to-axis distance control means for controlling an axis-to-axis distance between an axis about which the abrasive wheel is rotated and an axis about which the lens is rotated on the basis of said processing data;

moving speed calculating means for calculating a moving speed, at which a point of contact between the lens and the abrasive wheel moves during processing, on the basis of said configuration data or said processing data; and rotation control means for controlling a rotational speed of said lens rotating means on the basis of the thus calculated moving speed so that an actual speed at which the point of contact moves is made generally constant.

18. An eyeglass lens grinding machine according to claim 17, further comprising:

an edge thickness inputting means for entering an edge thickness of the lens, wherein said rotation control means sets a reference rotational speed of said lens rotating means on the basis of the entered edge thickness so that the rotational speed of the lens is slower as the edge thickness is larger.

19. An eyeglass lens grinding machine according to claim 17, wherein said moving speed calculating means calculates the moving speed on the basis of finish processing data or polish processing data obtained by said processing data calculating means, and said rotation control means controls the rotational speed of the said rotating means during finish processing or polish processing.

20. An eyeglass lens grinding machine for grinding a periphery of a lens to fit into an eyeglass frame, comprising:

processing means for processing the periphery of the lens using a rotating abrasive wheel;

lens rotating means for holding and rotating the lens;

configuration data inputting means for entering configuration data on the eyeglass frame or a template therefor;

layout data inputting means for entering data to be used in providing a layout of the lens corresponding to the eyeglass frame;

processing data calculating means for calculating rough processing data and finish processing data on the basis of the data entered by said configuration data inputting means and said layout data inputting means;

axis-to-axis distance control means for controlling an axis-to-axis distance between an axis about which the abrasive wheel is rotated and an axis about which the lens is rotated on the basis of said rough processing data and said finish processing data respectively;

detection means for detecting a processed portion of the lens during rough processing;

moving speed calculating means for calculating a moving speed, at which a contact point between the abrasive wheel and the lens moves during processing, on the basis of said finish processing data;

rotation control means for controlling a rotational speed of said lens rotating means during the rough processing on the basis of a result of detection by said detection means such that the rotational speed of said lens rotating means is faster for the processed portion of the lens than for the yet to be processed portion, and controlling the rotational speed of said lens rotating means during finish processing on the basis of the moving speed obtained by said moving speed calculating means such that an actual speed at which the point of contact moves is made generally constant.

21. An eyeglass lens grinding machine according to claim 20, wherein said processing data calculating means calculates polish processing data on the basis of the data entered by said configuration data input means and said layout data input means, and said rotation control means controls the rotational speed of said lens rotating means during polish processing on the basis of the moving speed obtained by said moving speed calculating means such that an actual speed at which the point of contact moves as made generally constant.

22. An eyeglass lens grinding machine according to claim 20, further comprising:

edge thickness input means for entering an edge thickness of the lens, wherein said rotation control means sets a reference rotational speed of said lens rotating means on the basis of the thus entered edge thickness such that the rotational speed of the lens is slower as the edge thickness is larger.

23. An eyeglass lens grinding machine according to claim 20, further comprising:

edge position detecting means for detecting an edge position on each of the front and rear surface of the lens, which is expected after completion of rough processing or finish processing, on the basis of said rough processing data or said finish processing data;

edge thickness calculating means for obtaining an edge thickness of the lens on the basis of the edge position thus detected;

wherein said rotation control means controls the rotational speed of said lens rotating means during rough processing on the basis of the edge thickness thus obtained so that the rotational speed of the lens is slower as the edge thickness is larger.

24. An eyeglass lens grinding machine for grinding a periphery of a lens to fit into an eyeglass frame, comprising:

a lens grinding section which processes the periphery of the lens using a rotating abrasive wheel;

a carriage which holds and rotates the lens;

a configuration data input section to allow entry of configuration data on the eyeglass frame or a template therefor;

a layout data input section to allow entry of data to be used in providing a layout of the lens corresponding to the eyeglass frame;

a control circuit which calculates data for rough processing and finish processing on the basis of the data entered by said configuration data input section and said layout data input section;

a control mechanism which controls axis-to-axis distance between an axis about which the abrasive wheel is rotated and an axis about which the lens is rotated on the basis of said rough processing data and said finish processing data respectively;

a detector which detects a processed portion of the lens during rough processing;

a moving speed calculator which calculates a moving speed, at which a contact point between the abrasive wheel and the lens moves during processing, on the basis of said finish processing data;

a lens rotation controller which controls a rotational speed of said carriage during the rough processing on the basis of a result of detection by said detector such that the rotational speed of said carriage is faster for the processed portion of the lens than for the yet to be processed portion, and controlling the rotational speed of said carriage during finish processing on the basis of the moving speed obtained by said moving speed calculator such that an actual speed at which the point of contact moves is made generally constant.

25. An eyeglass lens grinding machine for grinding a periphery of a lens to fit into an eyeglass frame, comprising:

a lens grinding section which processes the periphery of the lens using a rotating abrasive wheel;

a carriage which holds and rotates the lens;

a configuration data input section to allow entry of configuration data on the eyeglass frame or a template therefor;

a layout data input section to allow entry of data to be used in providing a layout of the lens corresponding to the eyeglass frame;

a control circuit which calculates processing data on the basis of the data entered by said configuration data input section and said layout data input section;

a control mechanism which controls axis-to-axis distance between an axis about which the abrasive wheel is rotated and an axis about which the lens is rotated on the basis of said processing data;

an edge position detector which detects an edge position on each of front and rear surfaces of the lens, which is expected after completion of rough processing or finish processing, on the basis of said processing data;

an edge thickness calculator which obtains an edge thickness of the lens on the basis of the edge position thus detected; and a lens rotation controller which controls a rotational speed of said carriage on the basis of the edge thickness thus obtained so that the rotational speed of the lens is slower as the edge thickness is larger.

* * * * *